United States Patent [19]

Fowles et al.

[11] 4,447,311

[45] May 8, 1984

[54] DEWAXING PROCESS

[75] Inventors: Patrick E. Fowles, Doylestown; Gerald L. Shoemaker, Yardley; Tsoung-Yuan Yan, Philadelphia, all of Pa.

[73] Assignee: Mobil Oil Corporation, New York, N.Y.

[21] Appl. No.: 400,841

[22] Filed: Jul. 22, 1982

[51] Int. Cl.[3] ..... C10G 73/06; C10G 73/26

[52] U.S. Cl. ..... 208/35; 208/33; 208/37

[58] Field of Search ..... 208/28, 33, 35, 37

[56] References Cited

U.S. PATENT DOCUMENTS

| | | | |
|---|---|---|---|
| 2,164,773 | 7/1939 | Knowles | 208/35 |
| 2,224,109 | 12/1940 | Stearns | 208/35 |
| 2,302,177 | 11/1942 | Bray et al. | 208/35 |
| 2,314,994 | 3/1943 | Lawson et al. | 208/33 |
| 2,370,453 | 2/1945 | Dons et al. | 208/33 |
| 2,719,817 | 10/1955 | Doorn | 208/37 |
| 2,760,904 | 8/1956 | Ford | 208/37 |
| 2,904,496 | 10/1959 | Bloch | 208/28 |
| 3,347,775 | 10/1967 | Tritsmans | 208/28 |
| 4,111,790 | 9/1978 | West | 208/33 |

*Primary Examiner*—Patrick Garvin
*Assistant Examiner*—Glenn A. Caldarola
*Attorney, Agent, or Firm*—Alexander J. McKillop; Michael G. Gilman; Richard D. Stone

[57] ABSTRACT

A dewaxing process for reducing the pour point of waxy oils in which the oil is cooled by direct contact with a liquid autorefrigerant such as propane. The wax which separates upon cooling is removed by flotation assisted by the bubbles of vaporized autorefrigerant which rise through the oil to form a frothy slurry of wax which can be decanted and the wax recovered from it. A dewaxing solvent such as methyl ethyl ketone may be used to assist separation of the wax.

20 Claims, 1 Drawing Figure

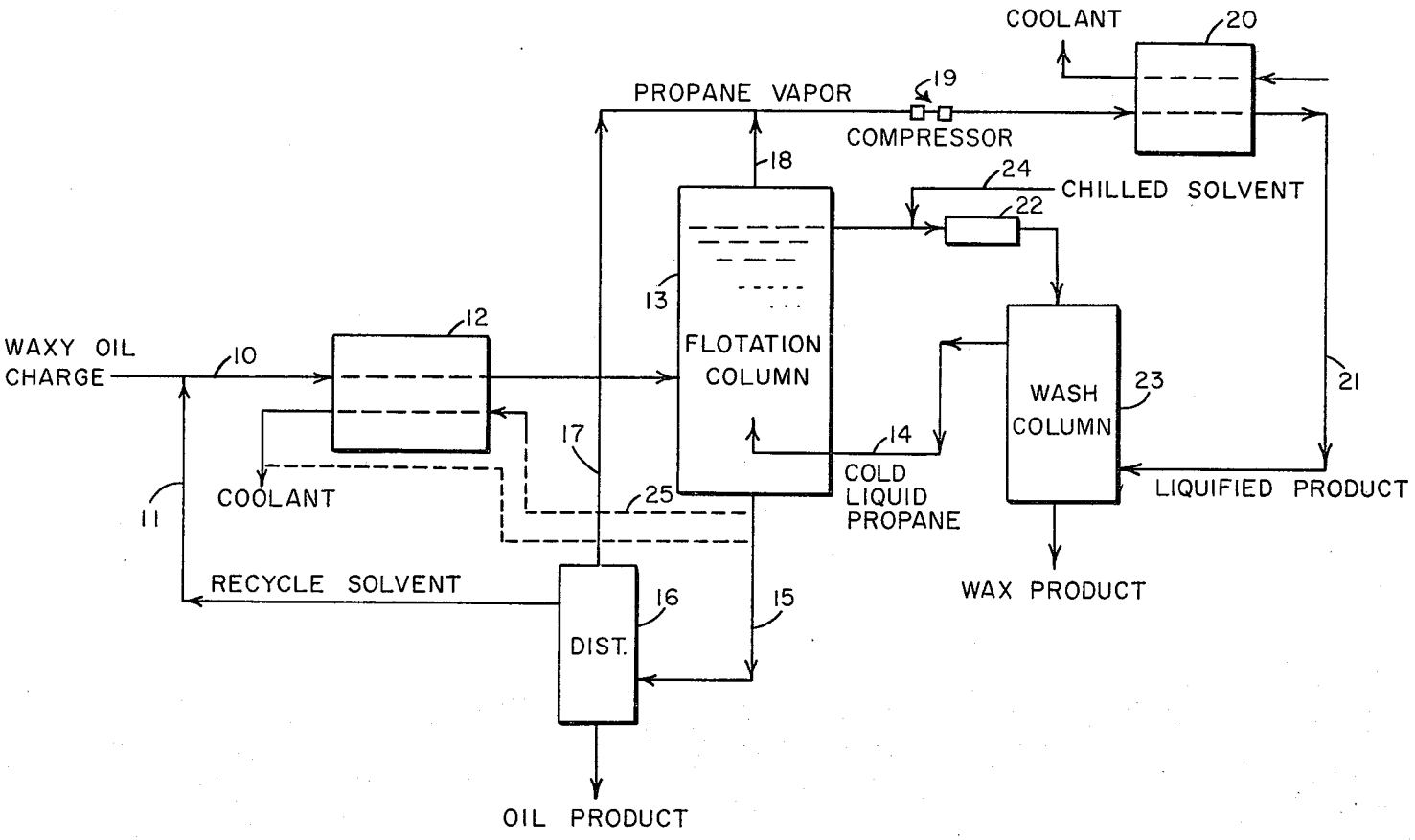
WAXY OIL CHARGE
10
11
12
COOLANT
RECYCLE SOLVENT
13
FLOTATION COLUMN
14
COLD LIQUID PROPANE
15
16
DIST.
OIL PRODUCT
17
25
18
PROPANE VAPOR
19
COMPRESSOR
24
22
CHILLED SOLVENT
23
WASH COLUMN
WAX PRODUCT
21
LIQUIFIED PRODUCT
20
COOLANT

DEWAXING PROCESS

FIELD OF THE INVENTION

This invention relates to a dewaxing process and more particularly to a dewaxing process employing autorefrigerative cooling.

BACKGROUND OF THE INVENTION

Solvent dewaxing process for removing waxy constituents from hydrocarbon oils, especially lubricating oil stocks, are well known in the petroleum refining industry and a number of different processes have been developed. In all of them, the waxy oil is mixed with a solvent and the resulting mixture is chilled to a temperature at which the wax crystallizes out of solution. The amount of wax removed from the oil is dependent upon a number of factors including the type of oil, the amount and type of solvent and the temperature to which the mixture of oil and solvent is chilled.

Two types of solvent dewaxing process have become predominant in the industry. The first is the ketone dewaxing process which employs a ketone such as acetone, methyl ethyl ketone (MEK) or methyl isobutyl ketone as a solvent, either on its own or in combination with an aromatic solvent such as benzene, toluene or naphtha. The solvent is mixed with the oil after which the mixture is chilled using a scraped surface heat exchanger or, alternatively, mixing and chilling are accomplished simultaneously by injecting cold solvent into the oil at a number of points along a cooling tower through which the waxy oil is passing. Scraped surface heat exchangers may be used for additional cooling. A major disadvantage of all the ketone dewaxing processes is the need for scraped surface heat exchangers.

The other principal type of process in use is the autorefrigerant process in which a low molecular weight, volatile hydrocarbon such as propane, which is a gas at normal temperatures and pressures is used as the solvent. The autorefrigerative solvent is added to the waxy oil as a liquid, under pressure. It is then allowed to evaporate and in so doing cools the mixture, causing the wax to separate. The disadvantage of this process compared to the ketone processes is that the relatively high solubility of wax in the autorefrigerant at any given temperature does not permit the removal of as much wax as is achieved with the ketone dewaxing processes at the same filtration temperature. The pour point of the dewaxed oil is therefore higher for a given filtration temperature. This means that the oil must be chilled to substantially lower temperatures than in ketone dewaxing processes in order to achieve a specified wax content or pour point.

Dual solvent systems have also been proposed, for example, in U.S. Pat. No. 3,503,870, using a ketone as well as an autorefrigerant such as propane or propylene. The ketone has the effect of reducing the solubility of the wax in the autorefrigerant thereby avoiding one of the disadvantages of the autorefrigerant system and, in addition, the evaporative cooling provided by the autorefrigerant minimizes the reliance on scraped heat exchangers, thereby avoiding a major disadvantage of the ketone dewaxing system.

All these dewaxing processes have one common disadvantage, namely that they rely upon the use of a filter to separate the wax from the oil and the solvent. Although rotary filter systems have achieved a high degree of efficiency, permitting continuous operation, they are relatively expensive both in capital and running costs. They need to be large in order to deal with the desired throughput and this results in a substantial capital cost; the necessity of maintaining both vacuum and positive pressure on different parts of the filter represents an increment to operational costs which would otherwise be avoided. It would therefore be desirable to find some way of eliminating the filtering step from the dewaxing process.

SUMMARY OF THE INVENTION

We have now devised a dewaxing process which eliminates the need for the filtering step characteristic of previous processes. According to the present invention the dewaxing process employs an autorefrigerant which cools the oil which is to be dewaxed by direct contact. The wax which separates from the oil is then removed by flotation, assisted by the vaporized autorefrigerant. The process may use a dewaxing solvent such as a ketone either alone or in combination with an aromatic solvent such as toluene in order to facilitate separation of the wax. Flotation agents may be used to increase the separation of the wax from the chilled liquid.

DRAWINGS

The single FIGURE of the accompanying drawings is a simplified schematic flow sheet of the present dewaxing process.

PREFERRED EMBODIMENTS OF THE INVENTION

The present dewaxing process preferably employs a dewaxing solvent which assists in the separation of the wax from the oil. The solvents employed mix readily with the oil to form a solution but have the effect of decreasing the solubility of the wax in the oil-solvent mixture so that the wax will crystallize out of the oil at a higher temperature. This, in turn, means that oils of lower pour point can be more readily produced with only a moderate degree of cooling in the process since the pour point of the dewaxed oil is dependent both upon the solubility of the wax in the oil and the temperature at which the dewaxing is performed. Thus, a reduction in the solubility of the wax means either that lower pour point oils may be produced at given operating temperatures or that a given pour point obtained at higher operating temperatures. Because the solvents employed in the process have this effect upon the solubility of the wax they are sometimes referred to as anti-solvents for the wax. Generally, ketones will be used for this purpose, with acetone, methyl ethyl ketone (MEK), methyl propyl ketones, methyl butyl ketones especially methyl iso-butyl ketone, being preferred.

The ketone may be used by itself or, more preferably, with an aromatic solvent such as benzene, toluene or petroleum naphtha which increases the solubility of the oil but diminishes the solubility of the wax. The amount of solvent used will be dependent upon other factors such as the pour point desired for the dewaxed product, the wax content of the feedstock (amount and type of wax), the design operating temperature of the system and the amount of autorefrigerant necessary. The amount required in any given case may be determined by appropriate experience or experiment but as a general guide will be from 1:1 to 4:1 (solvent:oil) based on the weight of the oil feed.

In the flowsheet of the process shown in the FIGURE, the waxy oil which is to be treated is admitted through pipe 10 and mixed with incoming solvent, e.g. MEK from pipe 11. Mixing of the two fluids may be assured by suitable provision of baffles, mixers or other devices. The oil/solvent mixture is then passed through a pre-cooler 12 which effects a partial chilling of the mixture. At this point, the temperature of the mixture should be controlled so as to minimize wax precipitation; nucleation should be avoided at this stage in order to secure the most favorable separation conditions in the subsequent flotation separation stage but since some wax may be expected to separate, especially with highly waxy feedstocks, it may be prudent to use a scraped surface heat exchanger for this purpose. After passing through pre-cooler 12, the mixture is fed to the bottom section of flotation column 13. The liquid autorefrigerant, e.g. liquid propane, is admitted to the bottom of column 13 from supply line 14 and as it enters the column it vaporizes and, in so doing, cools the mixture to a point at which the wax is nucleated and starts to crystallize. The vaporization of the autorefrigerant also ensures good mixing with the oil/solvent mixture although, if desired, this may be assisted by the use of spargers for the introduction of the autorefrigerant and swirling inlets for the oil/solvent mixture. Other agitators such as propellers may also be used if desired. The nucleation induced by the autorefrigerant should be as rapid, localized and as complete as possible in order to ensure good separation of the wax from the oil and good wax crystal formation. The spargers should therefore be designed and constructed with this end in view.

A wide variety of autorefrigerants may be used. In general, volatile materials having a boiling point below −5° C. (23° F.) will be suitable although higher boiling points may be accepted with some loss of efficiency. The volatile light ($C_1$–$C_4$) hydrocarbons are preferred, e.g. methane, ethane, propane, butanes, ethylene, propene, butenes. Other refrigerants such as the volatile alkyl halides, e.g. methyl bromide (b.p. 3.5° C.), methyl chloride (b.p. −24.2° C.) and the chlorofluorohydrocarbon refrigerants sold under the trademark Freon, e.g. Freon 22 (chloro difluoromethane, b.p. −40.8° C.). Freon 13 (chlorotrifluoromethane, b.p. −81° C.), Freon 12 (dichlorodifluoromethane, b.p. −29.8° C.), Freon 21 (dichlorofluoromethane, b.p. 9° C.), liquid ammonia (b.p. −33° C.), liquid sulfur dioxide (b.p. −10° C.) and liquid carbon dioxide (carbon dioxide is liquifiable at temperatures between the triple point −57° C. and the critical point 31° C.). The polar autorefrigerants such as liquid ammonia and liquid sulfur dioxide is preferred because these materials will exert a reduced solubilizing effect on the wax as compared to the light hydrocarbon refrigerants such as propane. The invention will, for convenience, be described below with reference to propane as the autorefrigerant but it should be understood that these other materials may be used and may be preferred.

The amount of autorefrigerant used will depend upon a number of factors including the pour point requirement for the product, the nature of the feed, the amount of solvent used, the temperature of the oil/solvent mixture and the latent heat of evaporation of the autorefrigerant. When the properties of the waxy oil and the pour point of the product are known, the temperature required in the separation/flotation column can be determined once the solvent:oil ratio is fixed, e.g. when MEK/toluene is used as the solvent, the column temperature will need to be only a few degrees e.g. 3° C. below the pour point of the dewaxed product. The amount of refrigerant required may then be calculated from the heat balance.

Upon vaporization, the autorefrigerant forms bubbles of vapor which coalesce to form a foam and which carry the separated wax crystals to the top of the column where they are separated in the form of a slurry by decantation over a weir or through a suitable exit port. Residence time in the column may be adjusted by control of the flow rates, suitably to a value from 10 minutes to 5 hours to obtain a desirable size distribution for the wax crystals. As the crystals ascend the flotation column, they may be expected to grow if conditions are favorable for this but if the temperature of the liquid increases with height in the column, the crystals may become partly redissolved in the liquid. This may be desirable, at least to a certain extent because the slightly branched chain hydrocarbons which do not contribute to high pour points to such a great extent will be the first to reenter the oil, thereby increasing the oil yield without affecting the pour point to such a great extent and, at the same time, increasing the purity of the wax product by the dissolution of the more soluble wax components and removal of occluded oil. However, if excessive temperature gradients occur, the separated wax may redissolve to an excessive extent. This may be avoided by suitable column design, e.g. selection of length to cross-section, insulation provision of cooling jacket, or by the injection of additional autorefrigerant at additional points higher up the column.

Crystal modifiers may be used to modify the crystal growth habits of the separated wax crystals, to increase crystal growth rate and to improve oil yield. Useful wax crystal modifiers and dewaxing aids which often function as pour point depressants are known and have conventionally been used in solvent dewaxing processes. Materials of this kind include, for example, polymeric alkylated naphthalenes e.g. Paraflow (Trademark) polystearyl methacrylates, hydrogenated butadiene-styrene random copolymers, halogenated paraffin-/aromatic hydrocarbon condensation products and their admixtures with long chain vinyl esters; their use is described, for example in U.S. Pat. Nos. 3,239,445, 3,479,278 and 3,475,321 to which reference is made for details of these materials and their use in other dewaxing processes.

Separation of the wax may also be improved by the use of flotation aids, surfactants or both. Flotation aids which function as flocculants assist the separation and subsequent removal of the wax crystals and their use is favored when non-polar autorefrigerants such as propane are employed because of the affinity between the non-polar wax components and the autorefrigerant. Flocculating agents of this kind may be similar to the high molecular weight crystal modifiers such as the hydrogenated butadiene-styrene random copolymers. The use of surfactants may be desirable when polar autorefrigerants such as liquid ammonia or sulfur dioxide are used in order to increase the affinity between the wax crystals and the rising gas bubbles of the autorefrigerant by modifying the surface properties of the non-polar wax crystals. Although the surfactants used may be cationic, anionic or non-ionic in nature, the anionic alkyl hydrophobes will be preferred. These surfactants have a long chain alkyl group attached to a polar group such as a sulfonate group to provide the desired balance of properties. The hydrophobic alkyl group has an affinity for the non polar wax crystals and the polar group for polar autorefrigerants such as liquid ammonia or sulfur dioxide, thereby increasing the affinity between the wax and the autorefrigerant. Non-ionic surfactants such as the polyethylene oxides are also useful since they tend to minimize contamination of the wax and cationic surfactants such as the long chain quaternary amines may also be used although, for preference, they should be of as simple a type as possible in order to minimize contamination of the wax. If the temperature gradient in the flotation column is such that a small amount of the separated wax is re-dissolved as the crystals ascend the column, the surfactant on the surface of the crystals may be removed together with the re-dissolved wax thereby ensuring a less contaminated wax product.

The dewaxed oil is withdrawn from the bottom of the column through line 15 and is then stripped in distillation column 16 to remove solvent and propane vapor. Solvent is recycled with any make-up necessary through line 11 to be mixed again with the waxy oil charge in pipe 10. The cold, dewaxed oil may optionally be circulated through cooling loop 25 to pre-cooler 12 for chilling the oil/solvent mixture entering the system. Propane vapor is removed as overheads from column 16 by pipe 17 and, together with more propane vapor removed from flotation column 13 by pipe 18, is compressed in compressor 19 and finally reliquified in condenser 20 from which it is recycled to the process through line 21.

The wax may be removed in the form of a slurry at the top of column 15 by means of a wier or by suitable mechanical devices such as skimmers, sweepers, endless chain buckets or the like. The wax is then circulated by means of slurry or screw pump 22 to a washing column 23 where it is washed with chilled dewaxing solvent or cold recycle autorefrigerant liquid from recycle line 21 to remove occluded oil. To improve the washing with autorefrigerant, the wax may first, if desired, be repulped with a small amount, e.g. 10 to 50 percent by weight of the wax, of chilled solvent introduced through supply line 24. The temperature of the washing solution may be controlled to melt small amounts, say 1 to 5 weight percent, of the small wax crystals which tend to adsorb and occlude oil and any solvent which may be present. Treatment with the wash solution in this way will also tend to remove any surfactant on the surface of the wax crystals. If a hydrocarbon autorefrigerant such as propane is used, the small amount of wax which melts may be taken up into solution in the refrigerant. The chilled autorefrigerant, containing any oil removed from the wax in wash column 23 then passes to flotation column 13 for treating fresh oil. The de-oiled wax product is withdrawn from the bottom of wash column 23.

The process may be used with a wide variety of waxy feedstocks and may be readily regulated to conform to the requirements of the feedstock and the dewaxed product. Thus, the operating temperature of the flotation column may be controlled so as to vary the pour point of the product by regulating the flow of autorefrigerant and its ratio to the oil/solvent mixture. The pre-cooler enables minor variations in the composition of the feed to be compensated for without altering the oil/refrigerant ratio. Economy of operation may be provided by using the cold, dewaxed oil as the coolant in the pre-cooler and, if desired, as the coolant also in condenser 20 for the compressed autorefrigerant.

We claim:

1. A dewaxing process for producing dewaxed oil from waxy oil which comprises:

contacting in a flotation column the waxy oil with a liquid autorefrigerant to cool the oil by vaporization of the autorefrigerant thereby causing crystallization of wax from the oil, and separating the wax from the oil by flotation to produce wax crystals and dewaxed oil wherein most of the wax separated from the oil by flotation is crystallized by vaporation of said liquid autorefrigerant and removed from an upper portion of said column wherein said dewaxed oil is removed from said column as a separate stream, substantially free of wax crystals, from a withdrawal point below the point of removal of said wax crystals.

2. A process according to claim 1 in which the crystallized wax is carried to the surface of the oil by bubbles of vaporized autorefrigerant.

3. A process according to claim 1 in which the autorefrigerant comprises a $C_1$–$C_4$ hydrocarbon.

4. A process according to claim 3 in which the autorefrigerant comprises propane.

5. A process according to claim 1 in which the autorefrigerant comprises a liquid polar compound.

6. A process according to claim 5 in which the autorefrigerant comprises liquid ammonia, liquid sulfur dioxide or liquid carbon dioxide.

7. A process according to claim 1 in which the waxy oil is mixed with a dewaxing solvent prior to contact with the autorefrigerant.

8. A process according to claim 7 in which the dewaxing solvent comprises a ketone or a mixture of a ketone and an aromatic hydrocarbon.

9. A process according to claim 8 in which the dewaxing solvent comprises methyl ethyl ketone or a mixture of methyl ethyl ketone and toluene.

10. A process according to claim 1 in which the waxy oil is contacted with the autorefrigerant in a flotation column into which the autorefrigerant is introduced at a position adjacent the bottom of the column, the separated wax is withdrawn adjacent the top of the column, the waxy oil is introduced at a position between the top and the bottom and dewaxed oil withdrawn from the bottom of the column.

11. A process according to claim 10 in which additional autorefrigerant is introduced into the column at one or more positions between the top and bottom of the flotation column to provide additional cooling at the point of introduction.

12. A process according to claim 10 in which the separated wax is washed with autorefrigerant or a chilled dewaxing solvent.

13. A process according to claim 12 in which 1 to 5 weight percent of the wax is melted during the washing step.

14. A process according to claim 1 in which the oil is cooled prior to contact with the autorefrigerant.

15. A process according to claim 14 in which the oil is cooled by heat exchange with dewaxed oil.

16. A solvent dewaxing process for reducing the pour point of a waxy oil feedstock, comprising the steps of:

(i) forming a mixture of the waxy oil feedstock with a dewaxing solvent, (ii) pre-cooling the mixture of oil and dewaxing solvent, (iii) contacting in a flotation column the pre-cooled mixture of oil and dewaxing solvent with a volatile liquid autorefrigerant to cause the liquid autorefrigerant to vaporize and further cool the precooled mixture thereby causing wax in the oil to crystallize and separate, wherein most crystallization is caused by vaporization of said liquid autorefrigerant, (iv) removing the separated wax from an upper portion of said column by flotation from the cooled mixture, and (v) recovering dewaxed oil of lower pour point from the cooled mixture from a withdrawal point below the point of removal of said wax crystals.

17. A process according to claim 16 in which the vaporization of the liquid autorefrigerant causes the separated wax to form a froth which rises to the surface of the cooled mixture, where the separated wax is decanted.

18. A process according to claim 16 in which the autorefrigerant comprises propane.

19. A process according to claim 16 in which the dewaxing solvent comprises a ketone or a mixture of a ketone and an aromatic hydrocarbon.

20. A process according to claim 19 in which the dewaxing solvent comprises methyl ethyl ketone or a mixture of methyl ethyl ketone and toluene.

* * * * *